US007021503B2

(12) United States Patent
Petit

(10) Patent No.: US 7,021,503 B2
(45) Date of Patent: Apr. 4, 2006

(54) METAL CRIMPING CAP FOR A FLUID DISPENSING DEVICE

(75) Inventor: Ludovic Petit, Vitot (FR)

(73) Assignee: Valois S.A.S., Le Neubourg (FR)

( * ) Notice: Subject to any disclaimer, the term of this patent is extended or adjusted under 35 U.S.C. 154(b) by 376 days.

(21) Appl. No.: 10/433,326

(22) PCT Filed: Apr. 3, 2002

(86) PCT No.: PCT/FR02/01159

§ 371 (c)(1),
(2), (4) Date: Sep. 5, 2003

(87) PCT Pub. No.: WO02/081332

PCT Pub. Date: Oct. 17, 2002

(65) Prior Publication Data

US 2004/0074926 A1 Apr. 22, 2004

(30) Foreign Application Priority Data

Apr. 4, 2001 (FR) ..... 01 04593

(51) Int. Cl.
*B65D 88/54* (2006.01)

(52) U.S. Cl. ..... 222/321.9; 222/402.13; 215/324

(58) Field of Classification Search ..... 322/321.9, 322/321.1–321.8, 402.1, 402.13; 220/309.1, 220/310.1, 915, 678, 679, 326; 53/470; 215/324, 215/327
See application file for complete search history.

(56) References Cited

U.S. PATENT DOCUMENTS 3,702,669 A 11/1972 Ewald
4,735,347 A * 4/1988 Schultz et al. ..... 222/321.2
4,958,757 A * 9/1990 Greenebaume, II ..... 222/394
5,046,644 A * 9/1991 Cater ..... 222/321.2
5,069,369 A * 12/1991 McGarvey ..... 222/321.9
5,108,013 A * 4/1992 VanBrocklin ..... 222/321.9
5,335,823 A * 8/1994 Fuchs et al. ..... 222/36
5,388,730 A * 2/1995 Abbott et al. ..... 222/153.13
5,692,650 A * 12/1997 Wolter et al. ..... 222/321.9
5,752,627 A * 5/1998 Vandromme et al. ..... 222/137
6,427,876 B1 * 8/2002 Fuchs ..... 222/321.2

FOREIGN PATENT DOCUMENTS

EP 0 317 865 A 5/1989
EP 0 875 469 A 11/1998
WO WO 84-01356 A 4/1984

* cited by examiner

*Primary Examiner*—Lien M Ngo
(74) *Attorney, Agent, or Firm*—Sughrue Mion, PLLC

(57) ABSTRACT

A metal crimping cap (10) for a fluid dispenser device, said cap (10) acting to fix a dispensing member (20) such as a pump or a valve to the neck (31) of a reservoir (30) containing fluid to be dispensed, said cap (10) having a fixing portion (11) for receiving said dispensing member (20) securely, and a crimping portion (12) which serves to be crimped to the neck (31) of the reservoir (30), said crimping portion (12) being provided with a covering element (15) made of a plastics material and extending over at least a fraction of the inside surface of said crimping portion (12), and over at least a fraction of the outside surface thereof, so that no metal particles are generated before, during and/or after crimping, said cap being characterized in that, on the outside surface of said crimping portion (12) of the cap (10), said covering element (15) is provided with retaining means (18) adapted to co-operate with a pusher to retain said pusher by preventing it from being removed from said dispensing member (20).

8 Claims, 3 Drawing Sheets

METAL CRIMPING CAP FOR A FLUID DISPENSING DEVICE

The present invention relates to a metal crimping cap, and to a fluid dispenser device including such a cap.

In fluid dispenser devices, crimping by means of a metal cap is a well known means for fixing a dispensing member such as a pump or a valve to a fluid reservoir. Such a cap generally includes a fixing portion in which the dispensing member is fixed, and a crimping portion which serves to be crimped onto the neck of the reservoir. A problem that can arise with that type of fixing relates to metal particles being generated during the crimping step, i.e. while the crimping portion is being deformed so as to become wedged under the neck of the reservoir. Such metal particles, even in very small quantities, can have an adverse effect on the dispensing member or on the fluid to be dispensed. That can be particularly problematic when the fluid in question is very sensitive and must under no circumstances come into contact with any metal particle. Metal particles can also be generated before or after crimping by caps striking one another in the assembly units.

Another problem that arises relates to the pusher being torn off intentionally or accidentally, which can lead in particular to the fluid contained in the device being contaminated.

An object of the present invention is to provide a crimping cap that does not reproduce the above-mentioned drawbacks.

More particularly, an object of the present invention is to provide a crimping cap for a fluid dispenser device that prevents any metal particles being generated before, during, and after the crimping step.

Another object of the present invention is to provide such a crimping cap that prevents effectively and simply any attempt to tear off a pusher or dispensing head connected to the dispensing member.

Another object of the present invention is to provide such a crimping cap that is simple and inexpensive to manufacture and to assemble.

The present invention thus provides a metal crimping cap for a fluid dispenser device, said cap acting to fix a dispensing member such as a pump or a valve to the neck of a reservoir containing fluid to be dispensed, said cap having a fixing portion for receiving said dispensing member securely, and a crimping portion which serves to be crimped to the neck of the reservoir, said crimping portion being provided with a covering element made of a plastics material and extending over at least a fraction of the inside surface of said crimping portion, and over at least a fraction of the outside surface thereof, so that no metal particles are generated before, during and/or after crimping, said cap being characterized in that, on the outside surface of said crimping portion of the cap, said covering element is provided with retaining means adapted to co-operate with a pusher to retain said pusher by preventing it from being removed from said dispensing member.

Advantageously, said covering element surrounds said crimping portion completely.

Advantageously, said covering element is extended over the inside surface of the cap by a radial flange that forms a sealing gasket for the neck of the reservoir.

Advantageously, said radial flange that forms the sealing gasket is extended by an extension or bushing that is preferably approximately frustoconical, and that co-operates in leaktight manner with said dispensing member.

Advantageously, said retaining means are formed by a peripheral rib that is adapted to co-operate, e.g. by snap-fastening, with a skirt on a pusher.

Advantageously, said covering element is provided with identification means making it possible to identify parameters characteristic of the fluid dispenser device and/or of the fluid.

Advantageously, said identification means are visual, such as color, and/or tactile.

The present invention also provides a fluid dispenser device including a dispensing member such as a pump or a valve fitted to a reservoir containing fluid, and including a crimping cap as described above, for fixing said dispensing member to the neck of the reservoir.

Other characteristics and advantages of the present invention appear more clearly on reading the following detailed description of three embodiments of it, given with reference to the accompanying drawings which are given by way of non-limiting example, and in which.

Figure 1:
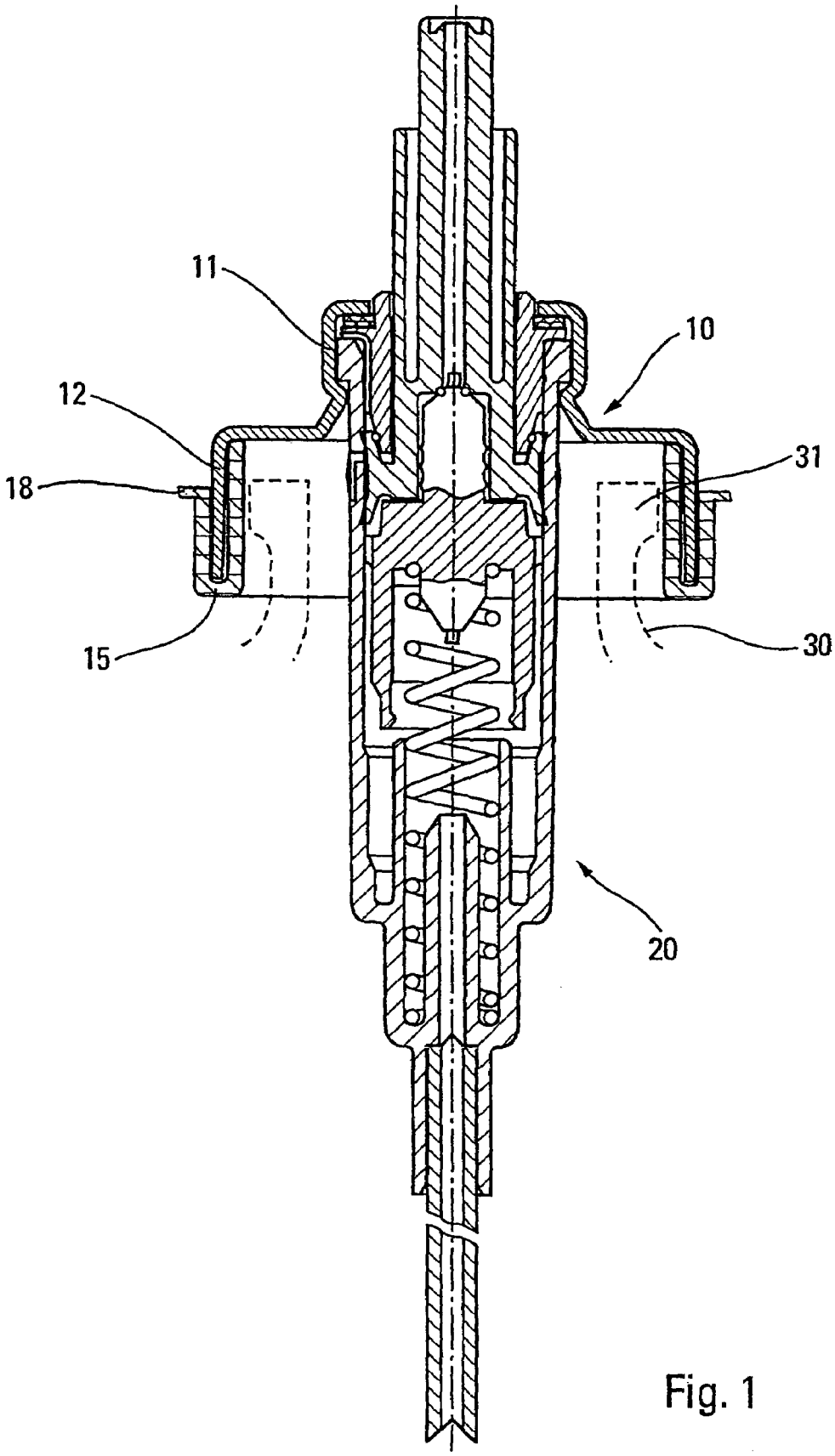
FIG. 1 is a diagrammatic section view of a first advantageous embodiment of the present invention.

The figures show a reservoir 30 having a neck 31 (since the reservoir is not involved directly in the present invention, it is shown only very diagrammatically in dashed lines in the figures). A dispensing member 20 which, in the figures, is a pump, but which could also be a valve or the like, is fixed to the neck of the reservoir by means of a crimping camp 10. In known manner, the crimping cap 10 has a fixing portion 11 in which the pump 20 is fixed, and a crimping portion 12 which serves to be crimped to the neck of the reservoir. The internal structure of the pump can naturally be of any type and is not involved in the present invention. It is not therefore described in any more detail below. It is to be understood that the pump shown in the figures is merely one possible example, it being possible for any pumps and valves to be used in the present invention.

In the invention, at its crimping portion 12, the cap is provided with a covering element 15 made of a plastics material, and extending over at least a fraction of the inside surface of the crimping portion and over at least a fraction of the outside surface thereof. In FIG. 1; it can be seen that the covering element 15 extends over the entire inside surface of the crimping portion 12 and over only a fraction of its outside surface. Advantageously, as shown in the figure, the covering element 15 surrounds the crimping portion 12 completely, so that the covering element forms a sort of continuous cylindrical recessed sleeve into which said crimping portion 12 of the cap 10 fits.

Before and after crimping, the covering element 15 prevents metal particles from being generated in the atmosphere, in particular due to impacts between caps. During crimping, i.e. while the crimping portion 12 is being deformed radially inwards to be fixed under the neck 31 of the reservoir 30, the presence of the covering element 15 prevents any metal particles from being generated in the atmosphere, and in particular in the vicinity of the pump 20 or of the reservoir 30. In this way, there is no risk of metal particles coming into contact with the fluid or with portions of the pump before, during and/or after assembly and filling of the device.

In the invention, on the outside surface of the crimping portion 12 of the cap 10, the covering element 15 is provided with retaining means 18 which are adapted to co-operate with a pusher (not shown) to hold said pusher securely on the pump 20, and in particular to prevent it from being removed or torn off intentionally or accidentally. For example, the retaining means 18 may be implemented in the form of an outside peripheral rib 18 which co-operates, e.g. by snap-fastening, with a skirt on the pusher. The rib may be continuous or segmented, and other equivalent retaining means, such as lugs, may be imagined. Similarly, the retaining means are shown in the drawings at an end edge of the covering element, but it is possible to dispose them differently on the outer portion of said covering element.

Figure 2:
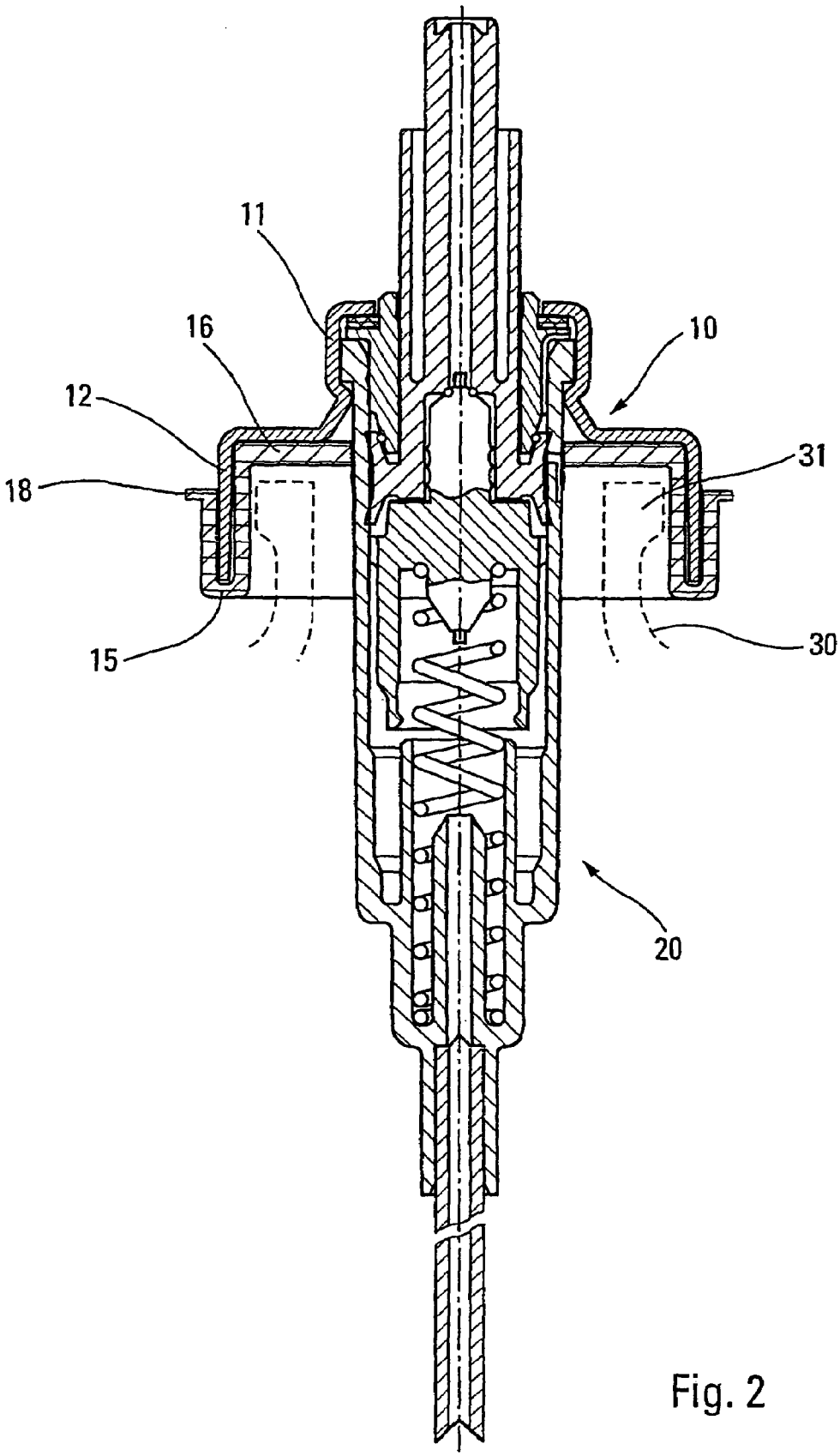
FIG. 2 is a view similar to FIG. 1, showing a second advantageous embodiment of the present invention.

FIG. 2 shows a first advantageous variant of the invention, in which the covering element 15, which extends over the entire inside surface of the crimping portion 12 of the cap 10, is extended by a radial flange 16 which advantageously forms a sealing gasket that cooperates with the top edge of the neck 31 of the reservoir 30.

Figure 3:
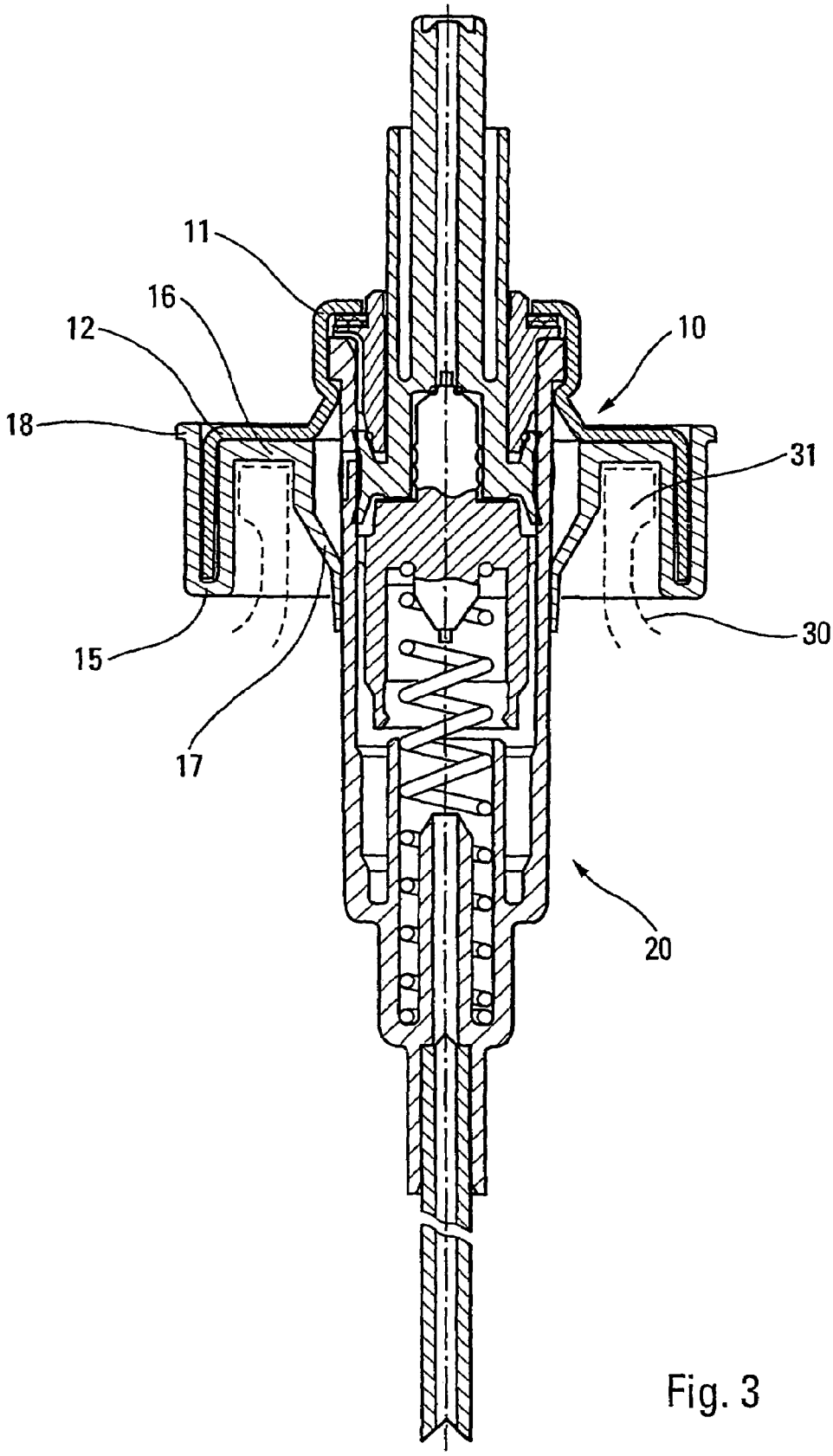
FIG. 3 is a view similar to FIGS. 1 and 2, showing a third advantageous embodiment of the present invention.

In the variant shown in FIG. 3, the radial flange 16 forming a sealing gasket is further extended by an extension or bushing 17 which is designed to co-operate in leaktight manner with the pump 20. The use of such a bushing 17 is well known, in particular for preventing the fluid from coming into contact with the venting hole in the pump, and it is therefore not explained in any more detail below. Advantageously, as shown in FIG. 3, said bushing 17 is substantially frustoconical, but other embodiments may naturally be considered.

The present invention thus relates to a covering element 15 that not only procures the advantage of preventing metal particles from being generated, but also forms a neck gasket and/or a bushing. Thus, in the version shown in FIG. 3, all four functions are obtained simultaneously by means of a single part, which is very simple and inexpensive to manufacture and to assemble onto the crimping cap 10, which represents a considerable saving in cost and a considerable simplification in the method of assembling the pump.

In addition, said covering element 15 may further be provided with identification means which make it possible to identify parameters that are characteristic either of the fluid dispenser device or of the fluid itself. For example, the identification means may be visual, e.g. a particular color, a set of colors, or an external pattern that enables the user to identify visually the parameters in question merely by looking at the outside of the crimping cap. It is also possible to imagine identification means that are tactile, e.g. formed by projections or other means that are easy for the user to recognize by touch. Among the characteristics that can be identified by means of said covering element 15, mention may be made, in particular, of the type of fluid to be dispensed, the quantity contained in the reservoir, whether the fluid is metered out in "doses", the volume of each metered "dose" of fluid dispensed by the pump, the type of use of the device, etc. Indeed, said parameters may be chosen in any manner such as to simplify the life of the user.

Although the present invention is described with reference to three particular variant embodiments of it, clearly it is not limited to the examples shown. The person skilled in the art may make any modifications to it without going beyond the ambit of the present invention, as defined by the accompanying claims.

The invention claimed is:

1. A metal crimping cap (10) for a fluid dispenser device, said cap (10) acting to fix a dispensing member (20) such as a pump or a valve to the neck (31) of a reservoir (30) containing fluid to be dispensed, said cap (10) having a fixing portion (11) for receiving said dispensing member (20) securely, and a crimping portion (12) which serves to be crimped to the neck (31) of the reservoir (30), said crimping portion (12) being provided with a covering element (15) made of a plastics material and extending over at least a fraction of the inside surface of said crimping portion (12), and over at least a fraction of the outside surface thereof, so that no metal particles are generated before, during and/or after crimping, said cap being characterized in that, on the outside surface of said crimping portion (12) of the cap (10), said covering element (15) is provided with retaining means (18) adapted to co-operate with a pusher to retain said pusher by preventing it from being removed from said dispensing member (20).

2. A cap according to claim 1, in which said covering element (15) surrounds said crimping portion (12) completely.

3. A cap according to claim 1, in which said covering element (15) is extended over the inside surface of the cap (1) by a radial flange (16) that forms a sealing gasket for the neck (31) of the reservoir.

4. A cap according to claim 3, in which said radial flange (16) that forms the sealing gasket is extended by an extension or bushing (17) that is preferably approximately frustoconical, and that co-operates in leaktight manner with said dispensing member (20).

5. A cap according to claim 1, in which said retaining means (18) are formed by a peripheral rib (18) that is adapted to co-operate, e.g. by snap-fastening, with a skirt on a pusher.

6. A cap according to claim 1, in which said covering element (15) is provided with identification means making it possible to identify parameters characteristic of the fluid dispenser device and/or of the fluid.

7. A cap according to claim 6, in which said identification means are visual, such as color, and/or tactile.

8. A fluid dispenser device including a dispensing member (20) such as a pump or a valve fitted to a reservoir (30) containing fluid, said fluid dispenser being characterized in that it includes a crimping cap (10) according to claim 1, for fixing said dispensing member (20) to the neck (31) of the reservoir (30).

* * * * *